US007331835B2

(12) United States Patent
Renard et al.

(10) Patent No.: US 7,331,835 B2
(45) Date of Patent: Feb. 19, 2008

(54) AQUATIC GLIDING BOARD

(75) Inventors: Philippe Renard, Moucy (FR); Eric Metrot, Applecross (AU)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/810,572

(22) Filed: Mar. 29, 2004

(65) Prior Publication Data

US 2004/0198112 A1 Oct. 7, 2004

Related U.S. Application Data

(63) Continuation-in-part of application No. 10/089,151, filed as application No. pct/fr01/02463 on Jul. 26, 2001, now Pat. No. 6,736,689.

(30) Foreign Application Priority Data

Jul. 28, 2000 (FR) ..... 00 10775

(51) Int. Cl.
*B63B 35/79* (2006.01)
*B63B 5/24* (2006.01)

(52) U.S. Cl. ..... 441/74; 114/39.14; 114/357; 441/65

(58) Field of Classification Search ..... 441/65, 441/74; 114/39.14, 357
See application file for complete search history.

(56) References Cited

U.S. PATENT DOCUMENTS

| | | | | |
|---|---|---|---|---|
| 3,429,758 A | | 2/1969 | Young | 156/79 |
| 3,514,798 A | * | 6/1970 | Ellis | 441/74 |
| 3,543,315 A | * | 12/1970 | Hoffman | 441/74 |
| 3,742,870 A | * | 7/1973 | Gusdorf et al. | 108/150 |
| 3,839,080 A | | 10/1974 | Jarema et al. | 117/132 B |
| 4,014,405 A | * | 3/1977 | Breisch | 182/186.5 |
| 4,118,814 A | | 10/1978 | Holtom | 9/6 P |
| 4,556,003 A | * | 12/1985 | Prade | 441/74 |
| 4,681,060 A | * | 7/1987 | Masters | 114/347 |
| 4,964,825 A | | 10/1990 | Paccoret et al. | 441/74 |
| 5,489,228 A | | 2/1996 | Richardson et al. | 441/74 |
| 5,618,215 A | * | 4/1997 | Glydon | 441/65 |
| 5,807,152 A | * | 9/1998 | Wojcik | 441/74 |
| 6,561,118 B2 | | 5/2003 | Mead | 114/357 |
| 6,669,519 B2 | | 12/2003 | Metrot | 441/65 |
| 6,692,321 B2 | | 2/2004 | Metrot | 441/74 |
| 6,736,689 B2 | * | 5/2004 | Renard et al. | 441/65 |
| 6,800,006 B1 | * | 10/2004 | Itnyre et al. | 441/74 |

FOREIGN PATENT DOCUMENTS

| | | |
|---|---|---|
| DE | 2829380 | 1/1980 |
| DE | 2935529 | 3/1981 |
| DE | 4306671 | 9/1994 |
| EP | 0 575 130 A1 * | 12/1993 |

* cited by examiner

*Primary Examiner*—Sherman Basinger
(74) *Attorney, Agent, or Firm*—Greenblum & Bernstein, P.L.C.

(57) ABSTRACT

An aquatic gliding board which incorporates a subassembly that includes a hollow inner shell which is covered with a casing made of foam capable of being machined. The invention also relates to a hollow gliding board, such as a surfboard, that includes at least one longitudinal partition, such partition(s) connecting upper and lower portions of the subassembly. The partition(s) is (are) made of a foam, such as an elastic foam.

74 Claims, 7 Drawing Sheets

AQUATIC GLIDING BOARD

CROSS-REFERENCE TO RELATED APPLICATIONS

This application is a continuation-in-part of application Ser. No. 10/089,151, filed in the U.S. Patent and Trademark Office on Apr. 19, 2002 now U.S. Pat. No. 6,736,689 as a national stage application of PCT/FR01/02463, which had been filed on Jul. 26, 2001, the disclosure of which is hereby incorporated by reference thereto in its entirety and the priority of which is claimed under 35 U.S.C. §120.

This application is also based upon French application No. 00.10775, filed on Jul. 28, 2000, the disclosure of which is hereby incorporated by reference thereto in its entirety and priority of which is hereby claimed under 35 U.S.C. §119.

BACKGROUND OF THE INVENTION

1. Field of the Invention

The invention relates to an aquatic gliding board, especially a surfboard.

More particularly, according to a particular embodiment, the invention relates to an aquatic gliding board made of a subassembly and an outer covering with one or more partitions within the board, particularly partitions made of a foam, such as an elastic foam.

2. Description of Background and Relevant Information

Conventionally, a surfboard is made from a foam blank, especially polyurethane foam blank, that is made in a mold. The foam blank is machined by planing and sanding over a small thickness to locally customize its shape, then it is covered with a casing made of resin-impregnated glass fibers that forms a reinforcing outer shell and provides the board with its final shape. A decoration and a glassing provide the board with its final appearance.

In certain cases, the foam blank is cut longitudinally into two portions that are then glued to a wooden stringer that reinforces its structure and imparts a predetermined longitudinal camber thereon.

The disadvantage of such a construction technique is the weight of the final board. Indeed, the foam is relatively thick; typically, its density is about 50 kg/m$^3$. In addition, it is a priori not possible to reduce the density of the foam without negatively affecting the mechanical properties of the board.

According to another construction technique derived from the sailboard, one begins with a relatively low density foam blank that is machined to shape. This blank is covered with a layer of resin-impregnated glass fibers. A casing made of a higher density foam is attached around this subassembly. Layers of resin-impregnated glass fibers are then applied in order to form the outer shell.

Such a construction mode enables a savings in weight of about 20% or more while maintaining a good rigidity beneath the feet. However, its implementation is relatively complex. Moreover, the central foam blank is generally made of polystyrene foam. This material has the flaw of taking in water. Over the course of its lifetime, the board sometimes hits a reef or a rock. If the outer shell is damaged, there is a risk of water penetration, the water weighing down the board and being particularly difficult to evacuate.

Finally, it is known to make hollow boards with sandwich layers. Alternatively, two half-shells, such as a deck and a hull, are made and then assembled to one another, or yet the assembly is made in a closed mold with an inner bladder that is inflated to push and press the sandwich layers against the walls of the mold.

This manufacturing technique makes it possible to make lightweight boards. However, it is not possible to customize the shape of the board. In this case, the shape of the outer shell depends exclusively upon the shape of the mold.

SUMMARY OF THE INVENTION

An object of the invention is to propose an improved subassembly, which makes it possible to make surfboards that are lighter while preserving a shape that can be customized, or more voluminous for an equal weight.

This object is achieved by a structural subassembly which, according to the invention, includes a hollow inner shell covered with a casing made of foam capable of being machined.

The board is characterized in that it includes the predefined assembly coated with at least one layer of resin-impregnated fibers.

According to another feature of the invention, the hollow board includes one or more partitions, or stringers, which can be made of a foam, particularly an elastic foam, which provides a certain elasticity to the upper half-shell relative to the lower half-shell, thereby conferring an increased liveliness to the board.

BRIEF DESCRIPTION OF DRAWINGS

The invention will be better understood from the description that follows, with reference to the annexed drawings, in which.

DETAILED DESCRIPTION OF THE INVENTION

Figure 1:
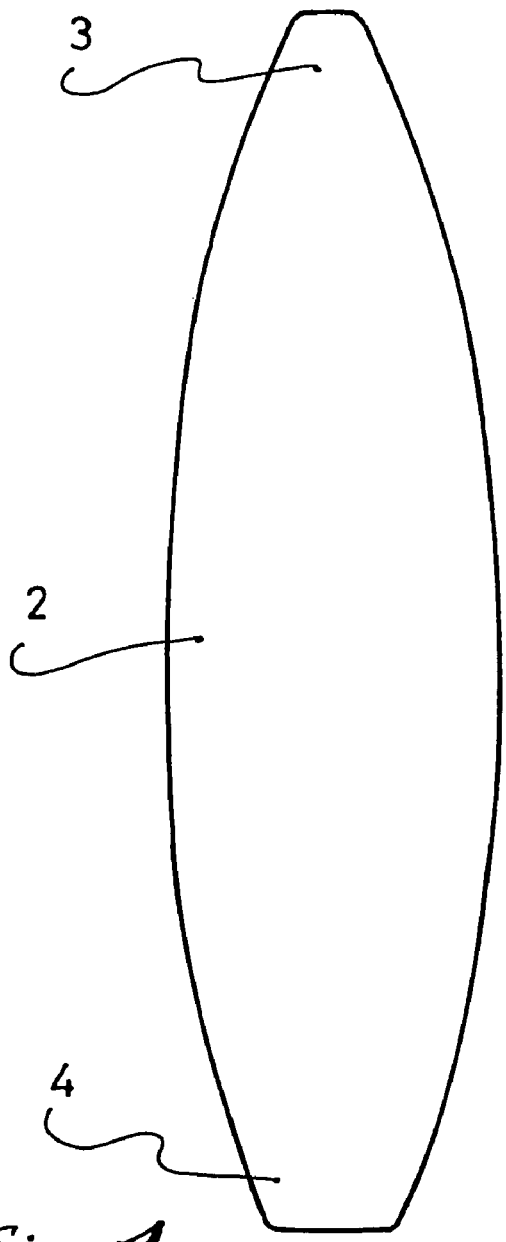
FIG. 1 is a top view of a surfboard.
Figure 2:
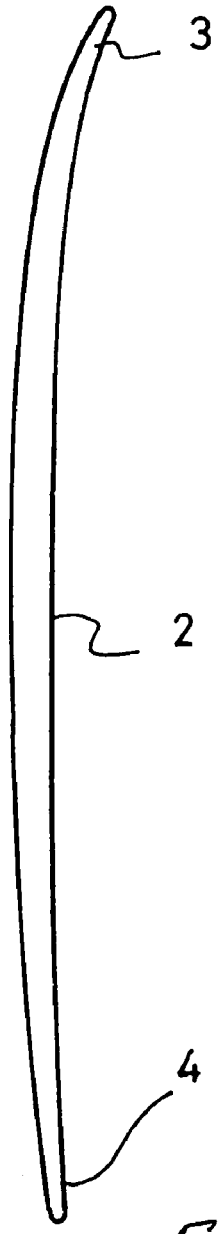
FIG. 2 is a side view of the board of FIG. 1.

With reference to FIGS. 1 and 2, a surfboard, in a known fashion, is in the form of an elongated board with a central portion 2, a tapered and slightly turned up front shovel 3, and a slightly turned up tail 4 and with a reduced width.

Figure 3:
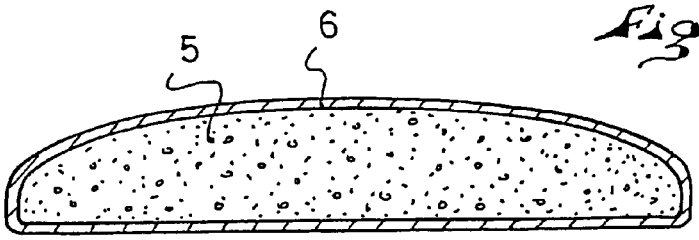
Fig: 3 PRIOR ART
FIG. 3 is a transverse cross-sectional view of a board made according to the prior art.

Conventionally, as shown in FIG. 3, the board is made of a foam blank 5, typically a polyurethane foam with a density of 50 kg/m$^3$, which is coated with a layer 6 of resin-coated fibers. Usually, the foam blank is made in a mold, and it is available in various models of variable length, width, volume and camber. Once selected by the shaper, the foam blank is provided with the desired final shape by local planing over a small thickness and, only thereafter, it receives its outer covering. This covering makes it possible to increase the mechanical features of the foam, and to protect the foam blank as well.

Figure 4:
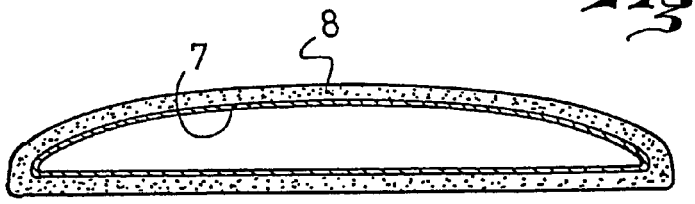
FIG. 4 shows a transverse cross-sectional view of the structural subassembly according to a first embodiment of the invention.
Figure 5:
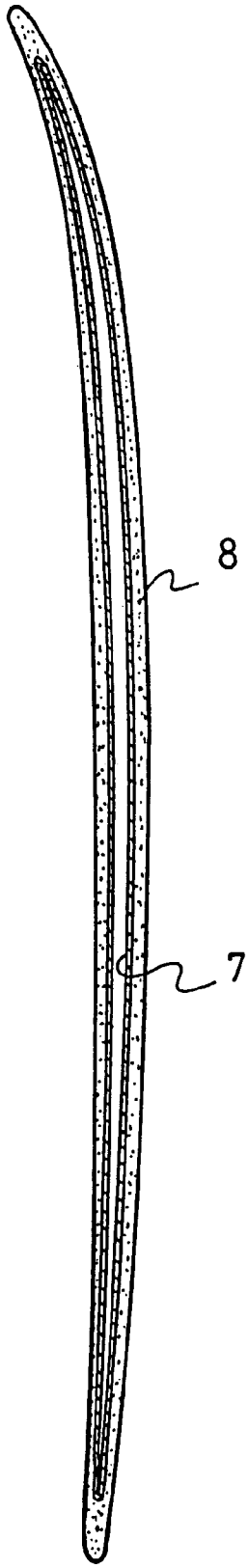
FIG. 5 is a longitudinal cross-sectional view of the board manufactured using the subassembly of FIG. 4.

FIGS. 4 and 5 show in a transverse cross-section and in a longitudinal cross-section, respectively, a structural subassembly of the board according to the invention, i.e., the subassembly that is located beneath the outer covering of the final board.

According to this first embodiment of the invention, the subassembly is formed by an inner shell 7 that is covered with a casing 8 made of foam. As shown in FIG. 4, for example, the outermost layer of the subassembly is the casing 8. This subassembly of inner shell and casing, without a final covering over the casing, can be regarded as a foam blank subassembly, or simply as a "blank", for the subsequent production of a gliding board.

The inner shell is hollow. This is a structural element made, for example, of glass fibers, carbon fibers or fibers of other synthetic material coated with resin, polyester resin, epoxy or the like.

For example, the inner shell is made with a thickness between 0.15 and 0.2 millimeters, or between 0.10 and 0.25 millimeters, or even more depending on the use intended for the board and the type of resin used. In certain cases, and depending on the material used, the thickness can reach 1-2 millimeters.

The inner shell can be manufactured according to various techniques. For example, it is formed around a central core made of polyester beads glued with vinyl glue, which is then dissolved in hot water. Other types of soluble mandrel or yet an inflatable bladder can be used.

According to another embodiment technique, the shell is manufactured by assembling a plurality of portions one to another. For example, the shell can be made from two half-shells which are nested into one another. The two portions are assembled by gluing or any other appropriate means. Still other possibilities exist.

The shell 7 can also be constructed with materials other than resin-impregnated fibers, for example a thermoplastic material, thermoplastic reinforced with fibers, fibers projected with a polyester matrix, stamped metal or any other material having a high elastic modulus.

The shell is covered with a casing 8. The casing is made of foam, but various types of foams can be used. For example, one can use a relatively dense PVC foam, with a density of 50-70 kg/m$^3$. One can also choose to use less dense foams, for example polyurethane foams of about 50 kg/m$^3$. One can also use (extruded or expanded) polystyrene foams of 30-50 kg/m$^3$ or yet polyether imide foams or any other waterproof foam.

The thickness of the casing is determined so as to enable a subsequent machining of this subassembly over this small thickness while having a final strong and lightweight subassembly. For example, the thickness is comprised between 3 and 15 millimeters, or even 20 millimeters. Possibly, one can provide a thickness that is greater along the lateral and front/rear edges of the subassembly, and smaller on the top and bottom. One can also provide different thicknesses on the top and bottom, front and rear.

To make the foam casing, foam sheets, or layers, are glued and curved to the shape of the shell by applying pressure, for example under vacuum by maintaining the interior of the shell at the atmospheric pressure so as not to deform this shell. An alternative is to place the shell at the center of a mold into which the foam is injected, or yet to cast or pulverize this foam on the shell and to allow it to expand in the open air. The polymerization of the foam ensures its superficial bonding with the shell. A primer can be applied to the surface of the shell to improve the performances.

The subassembly thus manufactured has the advantage of being lightweight and strong. Indeed, since the inner shell 7 is hollow, a significant savings in weight is achieved in relation to a conventional foam blank.

It is stronger than a conventional foam blank in view of its structure, with the inner shell and the relatively dense foam casing. The two elements cooperate complimentarily, the shell, due to its own resistance and to the closed shell effect, and the foam, due to its own strength and the spreading effect of the constraints which it generates at the surface of the shell and the role of the core in the final sandwich after the addition of the last superficial layer.

In addition, due to the aforementioned savings in weight, one can select a stronger and more condensed foam than a conventional foam, while preserving a markedly lower weight than that of the conventional board.

Figure 4A:
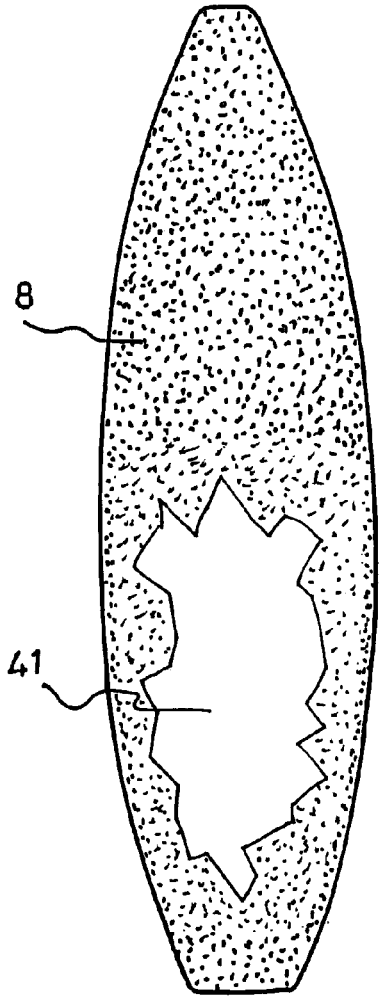
FIG. 4*a* shows a top view of the subassembly according to the first embodiment of the invention, with a schematically shown honeycombed structure for reinforcing the subassembly beneath the feet of the user, according to a variation.

Moreover, due to the thinness of the foam used and to the support of the shell, the surface 41 (shown as a schematic cutaway in FIG. 4*a*) beneath the feet can be reinforced by the addition of a honeycombed structure (plastic, cardboard, aluminum) at the time the foam is made.

Other filling materials, such as wood, or generally any material with a density of less than 1 can also be used.

The subassembly can be machined in the same manner as a conventional foam blank, depending on the shaper's preference, provided that the machining thickness remains less than the thickness of the foam.

As for the conventional blanks, the invention provides for the manufacture of a plurality of models of structural subassemblies with a variable length, width, thickness and camber. However, one can use a same model of shell for a plurality of models of boards, and can vary the form and thickness of the foam casing to have the desired final forms.

Figure 6:
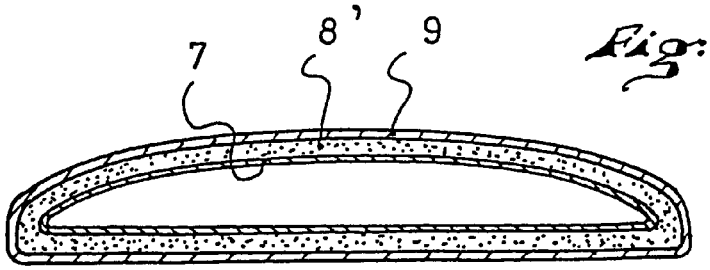
FIG. 6 shows the same board in a transverse cross-section.

Finally, once shaped, the structural subassembly with its shaped foam layer 8' is provided to be coated with a layer 9 made of resin-coated glass fibers or the like, and to receive the finishing operations in the same manner as a conventional board. This is shown in FIG. 6.

During use, given that the inner shell is hollow, a user would have less difficulty in evacuating the water, if necessary, which would have infiltrated following an impact due, in particular, to the incorporation of a drain plug. In this regard, one can provide inside the shell an inflated bladder that reduces the water penetration within the shell. This bladder can even be inflated with a lighter gas than air, for example helium, in order to lighten the structure even more.

Figure 7A:
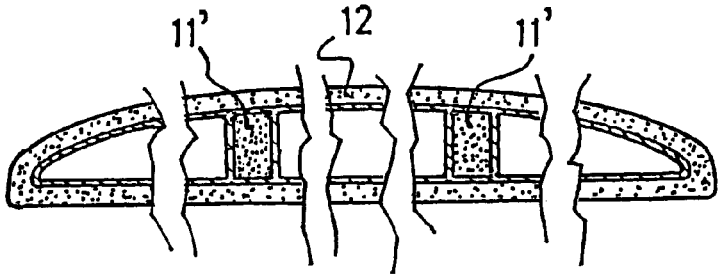
FIG. 7*a* shows a variation of the embodiment of FIG. 7, having a plurality of partitions, or stringers, within the shell of the subassembly.
Figure 7:
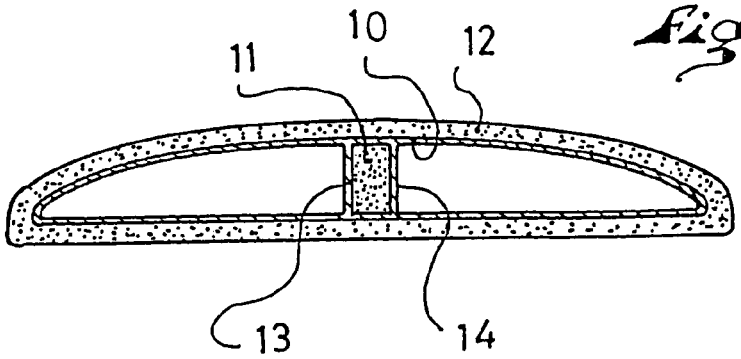
FIGS. 7, 8, and 9 are transverse cross-sectional views showing three alternative embodiments of the invention.

FIG. 7 relates to an alternative embodiment of the invention. According to this alternative, the inner shell 10 is reinforced by a central partition 11. Such a partition is commonly used, in particular for longboards, in order to provide them with a predetermined camber and a better longitudinal rigidity. Thus, although the embodiment of FIG. 7 can be regarded as including an inner shell 10 that is hollow, a partition is nevertheless provided, for the aforementioned reasons.

Figure 14:
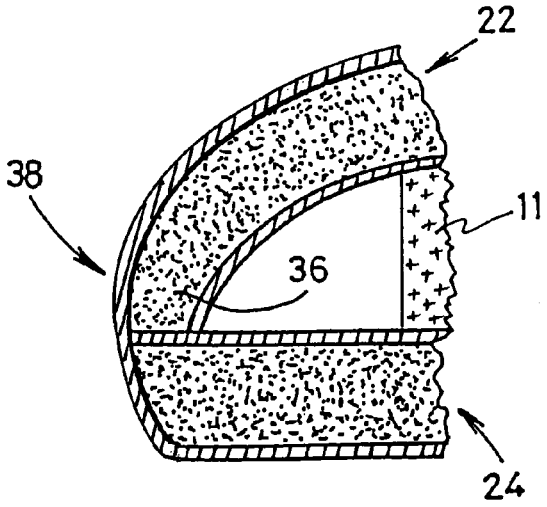
FIG. 14 show a partial cross-sectional view, like that of FIG. 13, although showing a completed board having at least one internal partition.

In the present case, the central partition 11 is made of foam or wood, for example. It extends over the length of the shell. The shell 10 is formed around this partition. Possibly, the partition is edged with two layers 13 and 14 of resin-impregnated fibers, which are continuously connected to the wall of the shell. In the variation shown in FIG. 7*a*, a plurality of partitions 11' is provided. If the possibility of layers 13 and 14 is not employed, the partition, such as a foam partition, is utilized as shown in FIG. 14, described further below.

As in the preceding case, the shell 10 is covered with a casing 12 made of foam.

Figure 8:
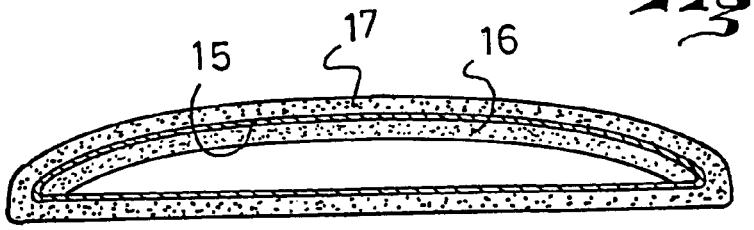

FIG. 8 relates to another alternative embodiment, where the upper wall of the shell 15 is supported by a previously curved foam sheet, or layer, 16.

To make the subassembly, for example, the layer 16 is shaped by thermoforming or any other appropriate technique.

Initially, the lower wall of the shell is made, on which the layer 16 is positioned.

Next, the manufacture of the shell is completed by covering the layer 16 with the layer of resin-impregnated fibers, the foam casing 17 is then formed.

This layer 16 increases the resistance to depression in the upper portion of the subassembly, i.e., beneath the surfer's feet.

Figure 9:
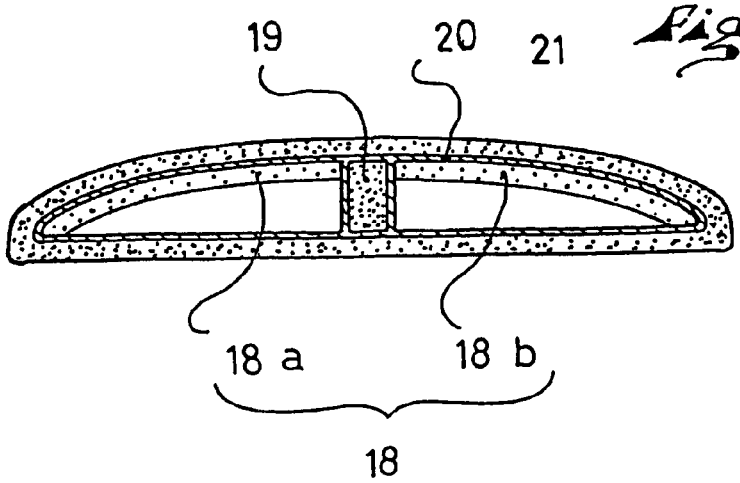

According to the alternative embodiment shown in FIG. 9, the layer 18 is made of two parts 18*a*, 18*b* that are joined in the area of a central partition 19 of the same type as the partition 11. As in the preceding case, the shell 20 is closed above the layer 18, and the envelope 21 is formed around the shell 20.

FIGS. 10-13 show another alternative embodiment of the invention in which the structural subassembly is made from two assembled half-shells. The subassembly can thus be formed of an upper half-shell 22, which will form the deck of the final board, and of a lower half-shell 24 which will form the hull. Each half-shell is formed of a foam sheet, or layer, 26, 28 that is first thermoformed in a mold, and then covered, over an inner surface 30, 32, with at least one layer of resin-impregnated fabric. Advantageously, the operation of laminating the inner surface 30, 32 of the half-shells 22, 24 is performed under vacuum, whereas the previously thermoformed foam sheet 26, 28 is still in the thermoforming mold, so that the layer of resin-coated fabric hardens on the thermoformed sheet, while the latter is still pressed against the mold. The form of the half-shell is thus guaranteed at best before the assembly.

When the two half-shells 22, 24 are assembled to one another, for example by gluing, one directly gets the rigid inner shell 7, which is formed by the layers of resin-coated fabric arranged on the inner surfaces of the half-shells, on the one hand, and the outer foam casing 8 capable of being machined, on the other hand. The foams used are for example sheets of extruded polystyrene foam having a density on the order of 30-50 kg/m$^3$.

To implement this alternative embodiment, it can be advantageous to provide that one of the half-shells, for the example the lower half-shell 24, also be laminated on its outer surface 34 before the assembly of the two half-shells. The half-shell thus laminated on its two surfaces 32, 34 is then particularly rigid during assembly with the other half-shell, which makes it possible to better control the precision of the assembly, and therefore the precision of the form of the subassembly. Of course, the foam casing covering the shell is then no longer capable of being machined over its entire area. Indeed, since one of the surfaces is already laminated at the time of assembly, the geometry of this surface can no longer be substantially modified. However, it has been noted that to modify the final behavior of the gliding board substantially, it often suffices to modify the geometry of the lateral edges of the board (generally referred to as the rails of the board). However, this geometry can be modified even if one of the outer surfaces of the board (for example the lower surface) is already laminated.

In the example shown in FIGS. 10-13, one can see that the two half-shells are not symmetrical. Indeed, one can see that the lower half-shell 24 does not include any lateral side-walls. During the shaping, the sheet, or layer, is bent longitudinally (which is therefore not visible in the drawings) so as to follow the longitudinal cambering curve (sometimes called the rocker curve or scoop curve). It could also be bent transversely, for example to form a V-shaped or double concave hull, but in the example shown, the lower half-shell does not have any transverse curvature. In this case, given that the deformation of the foam layer in relation to its initial planar state is relatively minimal, the shaping of the layer can be done without thermoforming, simply by applying the layer against the mold by depression at the time of lamination. After the resin is cured, the rigidity of the resin-coated fabric suffices to maintain the layer in the shape desired for the half-shell.

Figure 10:
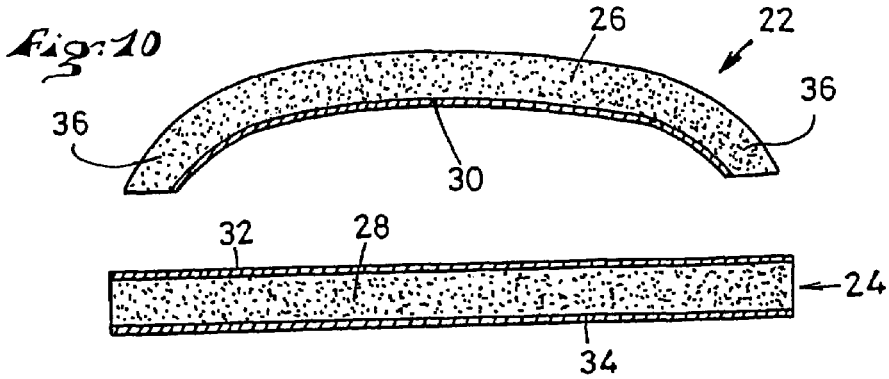
FIGS. 10-13 show transverse cross-sectional views of a fourth alternative embodiment of the invention in which the structural subassembly is made in the form of two half-shells.

Conversely, the upper half-shell 22 is thermoformed so as to be bent longitudinally, but also transversely to form downwardly curved lateral side-walls 36. According to the invention, the inner surfaces (i.e., the lower surface 30 of the upper half-shell 22 and the upper surface 32 of the lower half-shell 24) are laminated with one or several layers of thermosetting resin-impregnated fiber fabrics. As can be seen in FIG. 10, the lower surface 34 of the lower half-shell 24 is also laminated, before the assembly of the two half-shells.

Figure 11:
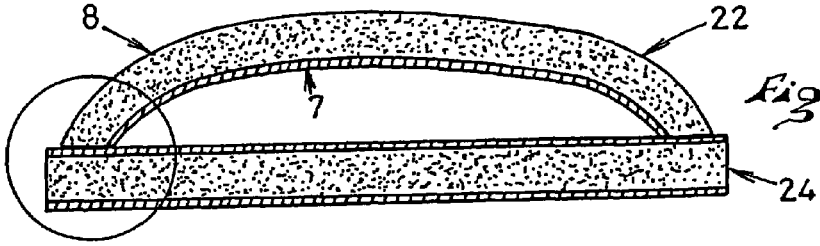

As can be seen in FIG. 11, the assembly of the two half-shells is made by gluing the lower edge of the lateral side-walls 36 of the upper half-shell 22 against the upper surface 32 of the lower half-shell 24. The glue is selected so that it is not too difficult to machine, i.e., so that it does not create any hard spot in the constituent foam of the lateral side-wall of the subassembly.

Figure 12:
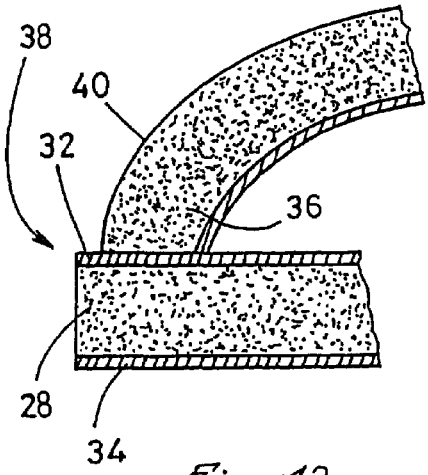
Figure 13:
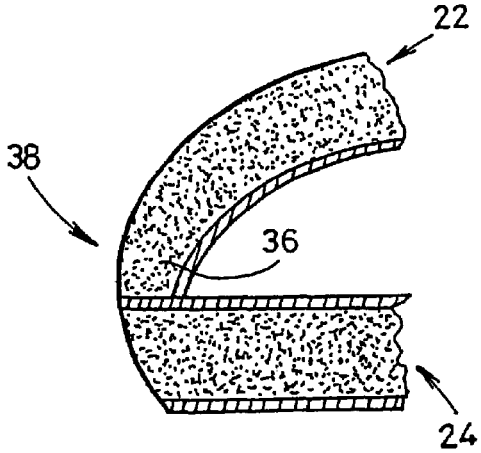

With this construction, it is seen in FIG. 12 (which shows in more detail the lateral edge of the subassembly right after the assembly) that the largest portion at the top of the lateral side-wall 38 of the structural assembly is formed by the lateral side-walls 36 of the upper half-shell whose outer surface 40 is made of foam. The lower portion of these lateral side-walls is constituted by the lateral edge of the lower half-shell which has a foam thickness 28 sandwiched (top and bottom) by two resin-impregnated fabric layers 32, 34. As the fabric layers 32, 34 are very thin, they do not impede the shaping of the lateral side-walls. Thus, one can see in FIG. 13 that the geometry of the lateral side-wall 38 of the structural subassembly has been modified over the entire height of the lateral side-wall 38, by machining, such as, for example by planing and sanding. Such removal of material, in the example of FIG. 13, as well as provided for in other embodiments of the invention, can result in the thickness of the outer casing to be non-uniform.

However, in an alternative embodiment (not shown), it can be provided that the peripheral portion of the upper surface 32 of the lower half-shell 24 not be laminated, so that the lateral side-walls 36 of the upper half-shell 22 are in support against the foam 28, in order to ensure a better continuity of the material forming the lateral side-wall 38, which then is only made of foam.

The lamination of the outer surface, in this case the lower surface 34 of the lower half-shell, can be integral (as illustrated). It can also only affect a portion of the surface, for example the central portion, to preserve a perfect machinability of the lateral edge 38.

With this construction, the precise assembly of the two half-shells is facilitated by the substantial rigidity of the lower half-shell, and the subassembly remains capable of being machined over its entire upper surface and on its lateral side-walls, which allows a great possibility to customize the subassembly. Once customized, the structural subassembly is covered with an outer layer of resin-impregnated fibers. As the case may be, one can choose to also cover the already laminated outer surface 34 of the subassembly with this outer layer so as to increase the rigidity and strength of the board, or conversely can choose not cover this already laminated surface 34 in order to limit the weight of the board.

Of course, in the case where one would prefer the possibility to customize the bottom of the board, it could be provided that the half-shell laminated on its two surfaces be the upper half-shell, the lower half-shell then only being laminated on its upper surface 32. In both cases, the subassembly thus made is a subassembly which, in the context of the invention, comprises a hollow and rigid inner shell, and a foam casing capable of being shaped which entirely covers this inner shell. Optionally, a portion of this casing (the geometry of which one does not wish to modify, for example the upper surface of the upper half-shell or the lower surface of the lower half-shell), can be covered with a rigid outer layer.

As in the case of the embodiments of FIGS. 7 and 9, one can provide advantageously the subassembly of FIGS. 10-13 with a longitudinal central partition that vertically connects the two half-shells.

One can also provide for several partitions, as in the case of the embodiment illustrated in FIG. 7*a*. As examples, two laterally spaced-apart longitudinal partitions can be employed, or three longitudinal partitions, including a central partition and a pair of partitions laterally spaced from the central partition can be employed. Other variations are also encompassed by the invention.

FIG. 14 shows a completed board, that is, one that includes an outer layer such as a layer 9 shown in FIG. 6. In addition, the board shown in FIG. 14 includes at least one stringer 11, i.e., at least one partition, without any covering, i.e., without coverings such as layers 13 and 14 shown in FIG. 7, such that at the sidewalls of the partition the foam is exposed to the inner cavity.

According to a particular embodiment encompassed by the invention, the plurality of partitions extend along the entire length of the board, that is, more exactly, the length of the inner cavity defined within the board by the inner shell, or at least along 70 to 80 percent of the length of the inner cavity.

Figure 15:
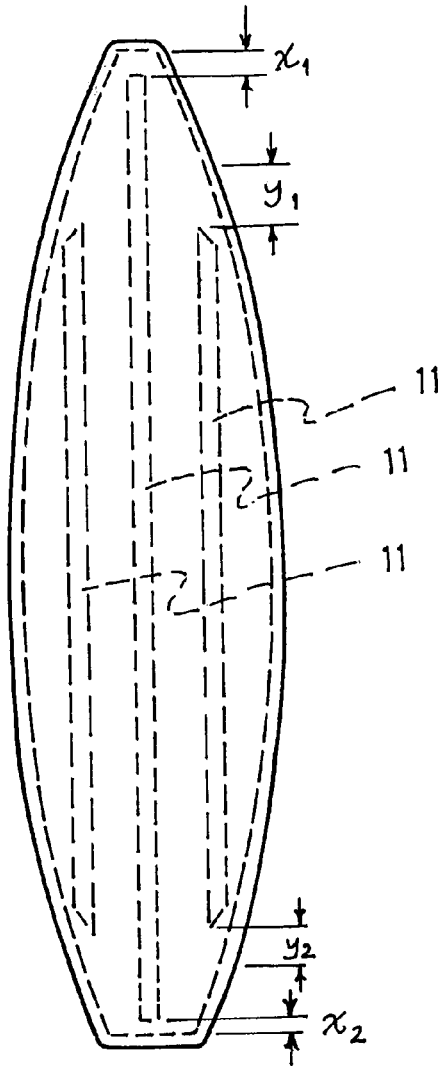
FIG. 15 shows a top view of a surfboard according to the invention, with three internal partitions shown in broken lines.

As an example, FIG. 15 illustrates a top view of a surfboard according to the invention, showing three partitions 11 in broken lines, designating the partitions being positioned within the hollow board. The central partition is shown to occupy less than the entire available longitudinal extent of the inner cavity by an amount equal to $x_1+x_2$, which can be at least about 70% or more of such extent. Similarly, the lateral partitions 11 are shown to occupy less than the entire available longitudinal extent of the inner cavity (which is less, of course, that the available longitudinal extent along the center median plane through which the center partition extends) by an amount equal to $y_1+y_2$, which can be at least about 70% or more of such extent. The values $x_1$ and $x_2$ can be equal or different and the values $y_1+y_2$ can be equal or different. In addition, while the minimum value of 70% or 80% of the available longitudinal extent is cited above, it is to be understood that the minimum value can conceivably be less than 70%, for example, provided that structural integrity of the board is maintained and, for example, the spring-back effect, described below, is produced.

According to a particular embodiment of the invention, whether one or more inner partitions are employed, the partition is made of a material which is elastic or visco-elastic, such as a foam, as mentioned above regarding partition(s) 11, 11'. More particularly according to a particular embodiment, the partition is made of foam which is elastic or visco-elastic, so as to permit a differential deformation of the upper half-shell and of the lower half shell. Indeed, the use of an elastic foam permits, when the surfer exerts a pressure with his foot on the upper surface of the board (which he does for example to initiate a turn), the pressure to cause the deck of the board to deflect, or "sink," under the foot, that is to deflect vertically, not due to the compression of the foam casing, but due to the flexion of the upper half-shell under the foot.

Because of the elastic foam of the partition, this vertical deflection of the deck will not be entirely transmitted to the lower half-shell. Indeed, the elastic foam will absorb part of the deformation energy transmitted to the board by the foot, therefore minimizing the deformation of the hull in contact with the water (the shape of the hull indeed is important because it determines the behavior of the board on the water, and it should therefore not be too greatly affected by the surfer's movements). With a conventional board, where the foam blank is made of rigid polyurethane foam, and where the central partition is rigid (for example made of wood), the deck has almost no possibility to deflect under the foot, and almost all of the deformation of the deck translates into a similar deformation of the hull. Therefore, the use of an elastically deformable foam smoothens the board's response to the pressure exerted by the foot.

Moreover, the foam being elastic, as soon as the surfer relieves the pressure exerted by his foot on the upper half-shell of the board, the elastic foam will retrieve the energy previously stored, so that the deck resumes almost instantaneously its initial position relative to the hull (i.e., the lower half-shell). This spring-back effect confers considerable liveliness to the board at the end of turns and, of course, it is very important that the board recovers its initial shape quickly, not being permanently deformed.

Both the benefits of the initial deflection of the upper half-shell and its later recovery are maximized with the construction of the subassembly and of the board according to the embodiment of FIGS. 10-15, where the two half shells are not symmetrical. As explained above, the lower half-shell 24 does not include any lateral side-walls, that is, it is not curved transversely or it is minimally curved transversely, while the upper half-shell 22 has downwardly curved lateral side-walls 36. The upper half-shell with the curved side-walls is indeed best suited to absorb the vertical deflection and to recover elastically its original shape.

The choice of the proper material for making the partition(s) needs to be very carefully made. For example, in the case of a board having a foam casing of extruded polystyrene it has been tested that a suitable material for the longitudinal partition(s) is polypropylene foam. Good results can be obtained with three longitudinal partitions, having a width of approximately 20 mm, and extending along approximately the entire length of the internal cavity defined by the inner shell. The partitions are spaced transversely apart by approximately 80 mm, the middle one being positioned along the longitudinal axis of the board. Of course, due to the shape of the board, the lateral partitions are shorter than the middle partition, although they extend along the entire length possible.

The polypropylene foam can be a polypropylene expanded particle foam (EPP) having a density of about 60 kg/m$^3$. Such a foam has compressive stress at 25% of deformation of around 350 kPa (measured according to ISO standard 844). Other tests have shown that similar foams having a density in the range of 20-100 kg/m$^3$ and having a compressive stress at 25% of deformation in the range of 100-600 kPa are also suitable for use in the invention. Such mechanical characteristics of the foam permit sufficient support of the upper half-shell, while also permitting sufficient deflection. A foam that is too weak, like some polyethylene foams which have a strength of 5 to 20 times less than the above-mentioned EPP foam, would not provide enough support to the upper half-shell, leading to possible delamination or even to a breakdown. A foam that is too rigid will not permit enough deflection and will adversely affect the behavior of the board on the water.

A foam according to the invention, should also have an advantageous ratio between the energy it stores when it is compressed and the energy it retrieves once it returns to its initial shape, that is, when the foot exerts less or no more pressure.

Polymeric foam materials are never perfectly elastic, even foams that are referred to as elastic. Instead, polymeric foams are better characterized as viscoelastic, which means that, of the energy that it had stored during compression, less than 100% is exerted by the material during a subsequent rebound, after the compressive force is removed or lessened. This difference, which is dissipated energy, has a positive effect for the invention, in that it provides a dampening effect. But if the dissipated energy is too significant, there will be no spring-back effect or the spring-back effect will be so marginal that it will have no practical benefit.

Therefore, a foam like the EPP foam mentioned above, which is advantageous for achieving results not shared by all foams in general, has a proper amount of energy dissipation to provide the required balance between dampening and spring-back of the deck or half-shell of the board according to the invention.

This description is provided for guidance only, and other embodiments thereof can be adopted without leaving the scope of the present invention. For example, one can double the inner shell and therefore have a stacking alternately including layers of fibers and layers of foam for the subassembly. One can also have a plurality of longitudinal, transverse, or otherwise appropriately directed partitions, these partitions forming connections between the top and the bottom of the board. Possibly, these partitions can create a partitioning of the inner shell into a plurality of waterproof compartments.

Moreover, the invention could be applied to the construction of boards other than surfboards, for example, boards for sailboards, boards adapted for swimming on waves and, generally, any aquatic activity in which the board operates mostly in the lift-off mode.

The invention claimed is:

1. A hollow surfboard comprising:

a lower half-shell having no lateral side-walls;

an upper half-shell comprising a sheet of foam having downwardly curved side-walls, said upper half-shell being adapted to support a standing person during use of the surfboard;

at least one longitudinal partition, at least said one longitudinal partition vertically connecting said lower and upper half-shells;

said longitudinal partition consisting essentially of foam;

said foam of said partition comprising a material having a compressible elasticity or viscoelasticity to allow said upper half-shell to deflect downwardly, relative to said lower half-shell, under pressure exerted by a foot of a user on said upper half-shell and to cause said upper half-shell to recover upwardly upon cessation of said pressure exerted by the foot.

2. A hollow surfboard according to claim 1, wherein:

said at least one longitudinal partition comprises a plurality of longitudinal partitions made of foam, said foam being exposed to an inner cavity of the board.

3. A hollow surfboard according to claim 2, wherein:

said longitudinal partition is made of a foam different from said foam of said sheet of foam of said upper half-shell.

4. A hollow surfboard according to claim 1, wherein:

said sheet of foam of said upper half-shell is a thermoformed foam sheet that has been thermoformed to form said downwardly curved side-walls.

5. A hollow surfboard according to claim 1, wherein:

said lower half shell has not been thermoformed.

6. A hollow surfboard according to claim 1, wherein:

said upper half-shell and said lower half-shell are assembled by gluing a lower edge of said sidewalls of said upper half-shell against an upper surface of said lower half-shell.

7. A hollow surfboard according to claim 1, wherein:

said at least one partition is made of polypropylene foam.

8. A hollow surfboard according to claim 7, wherein:

said polypropylene foam comprises an expanded polypropylene particle foam having a density of approximately 60 kg/m$^3$.

9. A hollow surfboard according to claim 8, wherein:

said expanded polypropylene particle foam has a compressive stress at 25% of deformation of approximately 350 kPa measured according to ISO standard 844.

10. A hollow surfboard according to claim 7, wherein:

said polypropylene foam comprises an expanded polypropylene particle foam having a density of approximately 20-100 kg/m$^3$.

11. A hollow surfboard according to claim 10, wherein:

said expanded polypropylene particle foam has a compressive stress at 25% of deformation of approximately 100-600 kPa measured according to ISO standard 844.

12. A hollow surfboard according to claim 1, wherein:

each of said at least one longitudinal partition extends along at least 70 percent of the length of the inner cavity.

13. A hollow surfboard according to claim 1, wherein:

said partition does not include a rigid honeycomb structure.

14. A hollow surfboard according to claim 1, wherein:

said foam of said longitudinal partition comprises a material continuous along a height and along a width of said foam.

15. A hollow surfboard according to claim 1, wherein:

said partition has a height and a width;

said foam of said longitudinal partition is continuous along the width of said partition through an entirety of said height of said longitudinal partition.

16. A hollow surfboard according to claim 1, wherein:

said upper half-shell is not symmetrical with respect to said lower half-shell.

17. A hollow surfboard according to claim 1, wherein:

said longitudinal partition has a height and a thickness, said partition consists essentially of foam along an entirety of said height and thickness with no internal reinforcing structure within said thickness.

18. A hollow surfboard according to claim 1, wherein:

said at least one longitudinal partition comprises a plurality of longitudinal partitions made of foam, each of opposite sides of said partitions comprising foam exposed to an inner cavity of the surfboard.

19. A hollow surfboard according to claim 1, wherein:

said at least one longitudinal partition comprises a most rigid partition of the surfboard, said most rigid partition is said longitudinal partition consisting essentially of foam.

20. A hollow surfboard according to claim 1, wherein:

said at least one longitudinal partition comprises at least two longitudinal partitions dividing an interior of the hollow surfboard into at least three cavities, both of said two longitudinal partitions consisting essentially of foam.

21. A hollow surfboard according to claim 1, wherein:

said sheet of foam comprises foam continuous along a length and a width of said sheet.

22. A hollow surfboard according to claim 1, wherein:

said upper half-shell is not reinforced with a honeycomb structure.

23. A hollow surfboard comprising:

a lower half-shell having no lateral side-walls;

an upper half-shell comprising a sheet of foam having downwardly curved side-walls, said upper half-shell being adapted to support a standing person during use of the surfboard;

at least one longitudinal partition, at least said one longitudinal partition vertically connecting said lower and upper half-shells;

said longitudinal partition consisting essentially of foam;

said at least one longitudinal partition being made of an elastic foam, said elastic foam, providing said upper half-shell with an ability to deflect relative to said lower half-shell under pressure exerted by a foot of the user, said elastic foam being exposed to an inner cavity of the board.

24. A hollow surfboard comprising:

a lower half-shell having no lateral side-walls;

an upper half-shell comprising a sheet of foam having downwardly curved side-walls, said upper half-shell being adapted to support a standing person during use of the surfboard;

at least one longitudinal partition, at least said one longitudinal partition vertically connecting said lower and upper half-shells;

said longitudinal partition consisting essentially of foam;

said at least one longitudinal partition comprising a plurality of longitudinal partitions made of foam, said foam being exposed to an inner cavity of the board;

said plurality of longitudinal partitions being made of an elastic foam providing said upper half-shell with an ability to deflect relative to said lower half-shell under pressure exerted by a foot of the user.

25. A hollow surfboard comprising:

a lower half-shell having no lateral side-walls;

an upper half-shell comprising a sheet of foam having downwardly curved side-walls, said upper half-shell being adapted to support a standing person during use of the surfboard;

at least one longitudinal partition, at least said one longitudinal partition vertically connecting said lower and upper half-shells;

said longitudinal partition consisting essentially of foam;

said foam sheet of said upper half-shell is laminated on opposite sides with at least one layer of resin-impregnated fibers.

26. A surfboard comprising:

a deck having a downwardly concave transverse cross section, said deck comprising a foam material, said deck being adapted to support a standing person during use of the surfboard;

a hull connected to said deck to form a subassembly, said hull comprising a foam material;

at least one longitudinally extending partition positioned within said subassembly interposed between said deck and said hull, said partition comprising a polymeric elastic foam material extending along at least a majority of a distance between said deck and said hull, said polymeric elastic foam material having a compressible elasticity or viscoelasticity to provide said deck with an ability to deflect downwardly under pressure exerted by a foot of a user on said deck relative to said hull and to cause said deck to recover from said deflection upon cessation of said pressure exerted by the foot.

27. A surfboard according to claim 26, wherein:

said foam of said longitudinally extending partition has a longitudinal side surface exposed to an inner cavity of the board.

28. A surfboard according to claim 26, wherein:

said material of said partition is polypropylene foam.

29. A surfboard according to claim 28, wherein:

said polypropylene foam comprises an expanded polypropylene particle foam.

30. A surfboard according to claim 26, wherein:

said foam material of said deck and said foam material of said hull comprise a polystyrene foam.

31. A surfboard according to claim 30, wherein:

said material of said partition is polypropylene foam.

32. A surfboard according to claim 31, wherein:

said polypropylene foam comprises expanded polypropylene particle foam.

33. A surfboard according to claim 26, wherein:

said foam material of said deck and said foam material of said hull comprise an extruded polystyrene foam.

34. A surfboard according to claim 33, wherein:

said material of said partition is polypropylene foam.

35. A surfboard according to claim 34, wherein:

said polypropylene foam comprises expanded polypropylene particle foam.

36. A surfboard according to claim 26, wherein:

said foam material of said deck and said foam material of said hull comprise a thermoformed extruded polystyrene foam.

37. A surfboard according to claim 36, wherein:

said material of said partition is polypropylene foam.

38. A surfboard according to claim 37, wherein:

said polypropylene foam comprises expanded polypropylene particle foam.

39. A surfboard according to claim 26, wherein:

said partition does not include a honeycomb structure.

40. A surfboard according to claim 26, wherein:

said partition has a height and a width;

said foam of said longitudinal partition comprises a material continuous along the width of said partition through an entirety of said height of said longitudinal partition.

41. A surfboard according to claim 26, wherein:

said longitudinal partition consists essentially of foam.

42. A surfboard according to claim 26, wherein:
said foam of said longitudinal partition is continuous along a height and a width of said longitudinally extending partition.

43. A surfboard according to claim 26, wherein:
said hull has no lateral side walls.

44. A surfboard according to claim 26, wherein:
said foam material of said deck is a polyurethane foam or a polyetherimide foam.

45. A surfboard according to claim 44, wherein:
said foam material of said partition is a polypropylene foam.

46. A surfboard according to claim 44, wherein:
said foam material of said partition is an expanded polypropylene foam.

47. A surfboard according to claim 26, wherein:
said foam material of said deck is a polystyrene foam.

48. A surfboard according to claim 26, wherein:
said deck further comprises a honeycomb structure in an area of said deck adapted to support a user's feet.

49. A surfboard according to claim 26, wherein:
said deck is not symmetrical with respect to said hull.

50. A surfboard according to claim 26, wherein:
said deck is not reinforced with a honeycomb structure.

51. A surfboard according to claim 26, wherein:
said foam material of said deck comprises a sheet of foam continuous along a length and a width of said sheet.

52. A surfboard according to claim 26, wherein:
said foam of said foam material of said longitudinally extending partition is less rigid than said foam of said foam material of said deck.

53. A hollow surfboard comprising:
a lower half-shell having no lateral side-walls;
an upper half-shell comprising a sheet of foam having downwardly curved side-walls, said upper half-shell being adapted to support a standing person during use of the surfboard;
at least one longitudinal partition, at least said one longitudinal partition vertically connecting said lower and upper half-shells;
said longitudinal partition consisting essentially of foam;
said upper half-shell further comprising a honeycomb structure in an area of said upper half-shell adapted to support a user's feet.

54. A surfboard comprising:
a deck adapted to support a standing person during use of the surfboard, said deck comprising a foam material;
a hull supporting said deck, said hull comprising a foam material, said deck and said hull enclosing an inner cavity having a length and a width;
at least one longitudinal partition consisting essentially of a foam material;
said partition extending between said deck and said hull along at least a portion of said length of said inner cavity and at least a majority of a height of said inner cavity to support said deck relative to said hull, said foam material of said partition allowing said deck to deflect downwardly relative to said hull under pressure exerted by a foot of a user on said deck.

55. A surfboard according to claim 54, wherein:
said longitudinal partition extends along at least about 70% of the length of said inner cavity.

56. A surfboard according to claim 54, wherein:
said deck is not symmetrical with respect to said hull.

57. A surfboard according to claim 54, wherein:
the board has an initial shape;
said partition comprises a polymeric elastic or viscoelastic compressible foam material;
said foam material provides said deck with an ability to deflect downwardly relative to said hull by compressing under pressure exerted by a foot of a user on said deck;
said foam material further provides said board with an ability to recover said initial shape upon cessation of said pressure of the foot of the user.

58. A surfboard according to claim 54, wherein:
said foam material of said deck comprises a sheet of foam continuous along a length and a width of said sheet.

59. A surfboard according to claim 54, wherein:
said foam of said foam material of said longitudinal partition is less rigid than said foam of said foam material of said deck.

60. A surfboard according to claim 54, wherein:
said at least one longitudinal partition comprises a plurality of longitudinal partitions, the foam of each of said partitions not being continuous with the foam of any other of said partitions.

61. A surfboard comprising:
a deck adapted to support a standing person during use of the surfboard, said deck comprising a foam material;
a hull supporting said deck, said hull comprising a foam material, said deck and said hull enclosing an inner cavity having a length, a width, and a height;
at least one longitudinal partition comprising a structural element to support said deck relative to said hull, said longitudinal partition comprising a polymeric foam material extending along substantially the height of said inner cavity from said deck to said hull, said foam material being compressible under a force exerted on the deck by the foot of the standing person;
said longitudinal partition further comprising no additional structural element extending along at least a majority of said height of said inner cavity.

62. A surfboard according to claim 61, wherein:
said longitudinal partition extends along at least about 70% of the length of said inner cavity.

63. A surfboard according to claim 61, wherein:
said deck is not symmetrical with respect to said hull.

64. A surfboard according to claim 61, wherein:
said foam material of said deck comprises a sheet of foam continuous along a length and a width of said sheet.

65. A surfboard according to claim 61, wherein:
said foam of said foam material of said longitudinal partition is less rigid than said foam of said foam material of said deck.

66. A hollow surfboard comprising:
a lower half-shell having no lateral side-walls;
an upper half-shell comprising a sheet of foam having downwardly curved side-walls, said upper half-shell being adapted to support a standing person during use of the surfboard;
at least one longitudinal partition, at least said one longitudinal partition vertically connecting said lower and upper half-shells;
said at least one longitudinal partition comprising a most rigid partition of the surfboard;
said most rigid partition consisting essentially of an elastic foam.

67. An aquatic gliding board comprising:
a hollow inner shell;
an outer shell;

a casing between said inner shell and said outer shell, said casing comprising at least one layer of a thermoformed extruded polystyrene foam;

at least one partition extending along a length of the board within said hollow inner shell, said partition being made of a material different from said thermoformed extruded polystyrene foam of said casing;

said casing comprising an upper part and a lower part, both of said upper and lower casing parts being comprised of said at least one layer of a thermoformed extruded polystyrene foam; and said longitudinally extending partition being made of a foam less rigid than said foam of said upper and lower casing parts.

68. An aquatic gliding board according to claim 67, wherein:

said at least one partition comprises a plurality of transversely spaced apart partitions extending along the length of the board.

69. An aquatic gliding board according to claim 67, wherein:

said partition is made of wood.

70. An aquatic gliding board according to claim 67, wherein:

said partition is made of foam.

71. A hollow surfboard comprising:

a lower half shell having no lateral side-walls;

an upper half-shell comprising a sheet of foam having downwardly curved side-walls, said upper half-shell being adapted to support a standing person during use of the surfboard;

a plurality of longitudinal partitions consisting essentially of foam, said foam being exposed to an inner cavity of the board;

at least one of said plurality of longitudinal partitions vertically connecting said lower and upper half-shells;

said plurality of longitudinal partitions being independently connected to said lower and upper half-shells, said foam of each of said partitions not being continuous with said foam of any other of said partitions.

72. An aquatic gliding board comprising:

a hollow inner shell;

an outer shell;

a casing between said inner shell and said outer shell, said casing comprising at least one layer of a thermoformed extruded polystyrene foam;

at least one longitudinally extending partition within said hollow inner shell, said partition being made of a foam different from said thermoformed extruded polystyrene foam of said casing;

said longitudinally extending partition is made of a foam less rigid than said foam of said casing.

73. A hollow surfboard according to claim 1, wherein:

no foam comprised of foam identical to said foam of said partition extends transversely beyond said partition.

74. A hollow surfboard according to claim 1, wherein:

said longitudinal partition is a single-wall partition.

* * * * *